United States Patent [19]

Conti et al.

[11] 4,014,188

[45] Mar. 29, 1977

[54] PANTY HOSE WITH IMPROVED WAIST OPENINGS

[76] Inventors: Paolo Conti, Via Neri di Bicci 14; Massimo Bianchi, Via Bisenzio 33, both of Florence, Italy

[22] Filed: Apr. 12, 1974

[21] Appl. No.: 460,582

[30] Foreign Application Priority Data

Apr. 13, 1973 Italy ..... 9420/73

[52] U.S. Cl. ..... 66/177; 66/172 R

[51] Int. Cl.[2] ..... A41B 9/14; D04B 1/00

[58] Field of Search ..... 66/172 R, 175, 176, 66/177, 172 E

[56] References Cited

UNITED STATES PATENTS

| | | | |
|---|---|---|---|
| 2,887,860 | 5/1959 | Bellman | 66/172 R |
| 3,159,990 | 12/1964 | Monday | 66/172 B |
| 3,262,288 | 7/1966 | Burd | 66/172 R |
| 3,670,529 | 6/1972 | Fregeolle | 66/177 |
| 3,673,821 | 7/1972 | Johnson | 66/177 |
| 3,748,870 | 7/1973 | Fregeolle | 66/177 |
| 3,815,385 | 6/1974 | Gariboldi | 66/177 |
| 3,924,423 | 12/1975 | Lonati | 66/172 E |

FOREIGN PATENTS OR APPLICATIONS

| | | | |
|---|---|---|---|
| 2,038,212 | 3/1971 | Germany | 66/177 |
| 1,938,623 | 2/1970 | Germany | 66/177 |
| 2,034,010 | 1/1971 | Germany | 66/177 |
| 7,302,860 | 10/1973 | Netherlands | 66/177 |

OTHER PUBLICATIONS

*Esta E4R for producing one-piece seamless pantyhose* in Knitting Times: pp. 33–37, June 11, 1973.

Goadly, D. R., *Billi's Pair of One-Piece Pantie-Hose*, in the Hosiery Trade Journal, 80(954): pp. 99–100, June 1973.

Santoni, "*Thread Through*" *Is the Latest Pantie-Hose Development*, in the Hosiery Trade Journal: p. 13, Sept. 1972.

*Primary Examiner*—Mervin Stein
*Assistant Examiner*—Andrew M. Falik

[57] ABSTRACT

A continuous, tubular, one-piece panty hose is formed on a circular knitting machine, wherein the waist opening extends both transversely of the direction of knitting as well as longitudinally of the direction of knitting to form a generally rectangular opening which is surrounded by a reinforced elastic section with stitches that resist raveling or breakdown.

5 Claims, 13 Drawing Figures

| | | | | | |
|---|---|---|---|---|---|
| k | k | k | k | k | k |
| K | K | K | K | K | K |
| k | t | k | t | k | t |
| K | K | K | K | K | K |
| k | t | k | t | k | t |

Fig. 5A

| | | | | | |
|---|---|---|---|---|---|
| k | k | k | k | k | k |
| K | K | K | K | K | K |
| k | t | k | t | k | t |
| K | K | K | K | K | K |
| K | t | K | t | K | t |
| K | K | K | K | K | K |

Fig. 7A

| | | | | | | | | | | | | | | |
|---|---|---|---|---|---|---|---|---|---|---|---|---|---|---|
| K | K | K | K | K | K | K | K | K | K | K | K | K | K | K |
| k | k | k | k | k | k | k | k | k | k | k | k | k | k | k |
| K | K | K | K | K | K | K | K | K | K | K | K | K | K | K |
| k | k | k | k | k | k | k | k | k | k | k | k | k | k | k |
| K | K | K | K | K | K | K | K | K | K | K | K | K | K | K |
| t | k | t | k | t | k | t | K | t | K | t | K | K | K | K |
| K | K | K | K | K | K | K | K | K | K | K | K. | K | K | K |
| t | k | t | k | t | k | t | K | t | K | t | K | K | K | K |
| K | K | K | K | K | K | K | K | K | K | K | K | K | K | K |
| | | | | | | | | t | K | t | K | K | K | K |
| | | | | | | | | K | K | K | K | K | K | K |
| | | | | | | | | t | K | t | K | K | K | K |
| | | | | | | | | K | K | K | K | K | K | K |
| | | | | | | | | t | K | t | K | K | K | K |
| | | | | | | | | K | K | K | K | K | K | K |
| | | | | | | | | t | K | t | K | K | K | K |
| | | | | | | | | K | K | K | K | K | K | K |

Fig. 10A

PANTY HOSE WITH IMPROVED WAIST OPENINGS

BACKGROUND OF THE INVENTION

In the knitting of one-piece panty hose it is conventional to form the waist opening during the knitting operation as described, for example, in U.S. Pat. No. 3,673,821 to Johnson. In most instances the waist opening is defined by a cut or slit extending wale-wise along the knitted fabric, that is in the direction of knitting. This is objectionable because in the finished product the dimension between the waist opening and the crotch is limited by the diameter of the knitting machine, which is conventionally about 4 or 4½ inches.

There have been prior attempts to form the waist opening during knitting on a circular knitting machine in a direction transverse to the direction of knitting or course-wise of the knitted article, but considerable difficulties have been encountered in preventing breakdown of the stitches bordering the waist opening.

SUMMARY OF THE INVENTION

According to the invention, the waist opening is formed by first clearing all needles from the stitches throughout a portion of the arc of needles to form a first transverse edge or lip. Subsequently, a plurality of partial courses are formed longitudinally of the panty hose, the ends of said partial courses being sheared at the edge of said waist opening to form a pair of spaced longitudinal lips or edges. Finally the yarn is reintroduced to the needles throughout the entire needle cylinder to form a second transverse edge and resume knitting after the generally rectangular waist opening has been formed. The fabric in an edge zone surrounding the top, bottom and sides of the transverse opening comprise courses having an added elastic yarn. The portions of such edge zones immediately adjacent the lips or edges of the opening provide the fabric with tuck stitches that hold well and offer high elasticity and a tendancy to roll up along the opening edges or rims. In the edge zones, preferably, a course of stitches with an elastic yarn and a non-elastic yarn is formed alternately with a course of stitches having only non-elastic yarn or yarns.

The retained or tuck stitches in the portions of the edge zone immediately adjacent the lips or edges of the opening are preferably formed by a 1:1 needle selection in selected courses which provides a retained stitch alternated with plain or conventional stitch in such courses.

In the portions of the edge zone adjacent the ends of the transverse lips and at the ends of the partial courses adjacent the longitudinal lips are preferably reinforced by introducing a supplementary yarn which is added into alternate courses in which the elastic yarn is not present. This reinforced fabric with the supplementary reinforcing yarn may have adjacent the lips of the opening an interlaced knitting effect such as that obtained by the 1:1 technique, while in the development of the remainder of the edge zone at the side edges of the opening a plain stitch technique is used.

The distances between the top and bottom edges of the rectangular opening are, of course, determined by the number of partial courses therebetween, which may be varied depending on the size or other requirements of the article to be knit.

The invention also relates to the article formed by the above-defined method.

The invention will be better understood following an understanding of the description and accompanying drawings, which illustrate a practicle embodiment of the invention.

In the drawings:

FIG. 5A is a geometrical representation of the stitches of the FIG. 5 stitch diagram;

FIG. 7A is a geometrical representation of the stitches or the FIG. 7 stitch diagram;

FIG. 10A is a geometrical representation of the stitches of the FIG. 10 stitch diagram.

DETAILED DESCRIPTION OF THE INVENTION

Figure 1:
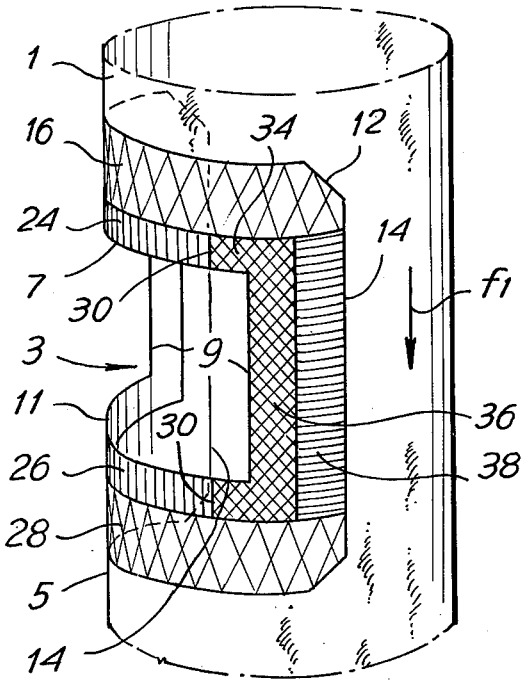
FIG. 1 is schematically illustrative of the development of the body portion of the panty hose in accordance with the present invention.

Turning now to FIG. 1 of the drawings, a length 1 of the panty hose is formed before or prior to the opening 3 with the knitting operation proceeding in the direction $f_1$. The waist opening 3 is then formed as described hereinafter, whereupon a second length 5 of the fabric is formed subsequently.

The opening 3 is defined by a first transversely extending edge or lip 7 which is formed by clearing a first arcuate section of needles in the needle cylinder from the stitches immediately preceding the lip 7. This is accomplished conventionally by raising and subsequently relowering the needles of the arcuate section without seizing yarn to form a new loop. Such needle selection is well known in the art and reference is made to U.S. Pat. No. 3,811,296 and British Patent 1,362,211 which show conventional means for needle selection and yarn feed. A pair of longitudinal edges or lips 9 are then formed by a plurality of partial courses which are formed by the needles of the cylinder which were not cleared to form edge 7, hereinafter called the "needles of the conjugate or explementary arc." As the needle cylinder revolves continuously, and knitting of the partial courses occurs, the side edges of the opening are formed by shearing the yarns in each course at the ends of the needles of the conjugate or explementary arc. The shearing may be performed by any of several conventional systems. The second lip 11, opposite lip 7 is begun in a conventional manner immediately after the forming of the partial courses which define the longitudinal edges or lips 9, and with the same needles of the first arc of needles from which were previously released the stitches along the edge 7. The knitting of the first course of edge 11 is begun with preferably a 1:1 needle selection to form the tucked stitches, although all needles could be restarted in the initial course.

Around the edges or lips 7,9, and 11 of opening 3, different zones 16, 24, 26, 28, 36, and 38 of fabric are formed with respect to the fabric of the tubular article 1,5 to constitute a finishing edge around openings 3, said edge being preferably of an elastic type. In particular, along lines 12,14, the insertion and disengagement of auxiliary yarns takes place to form said finishing edge. During the knitting of the article in the area of opening 3, the insertion and disengagement of auxiliary yarns is effected by raising selected needles along a prescribed arc in such a manner as to pick up an auxiliary yarn only in the zones in which that yarn is intended to be knit.

Figure 2:
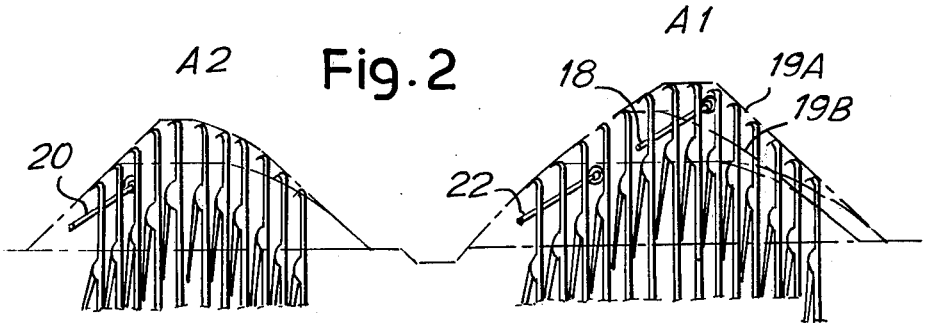
FIG. 2 is a schematic view illustrating the positioning of the incoming yarn and needle arrangement at two consecutive feeds in the transverse edge zones above and below the transversely extending edges of the waist opening.
Figure 3:
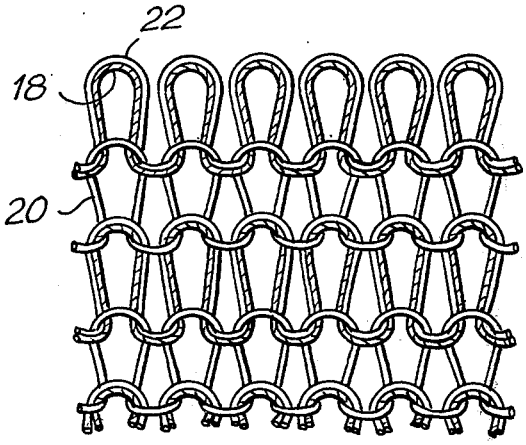
FIG. 3 is a pictorial stitch diagram illustrating the fabric formed from the set-up of FIG. 2.
Figure 10:
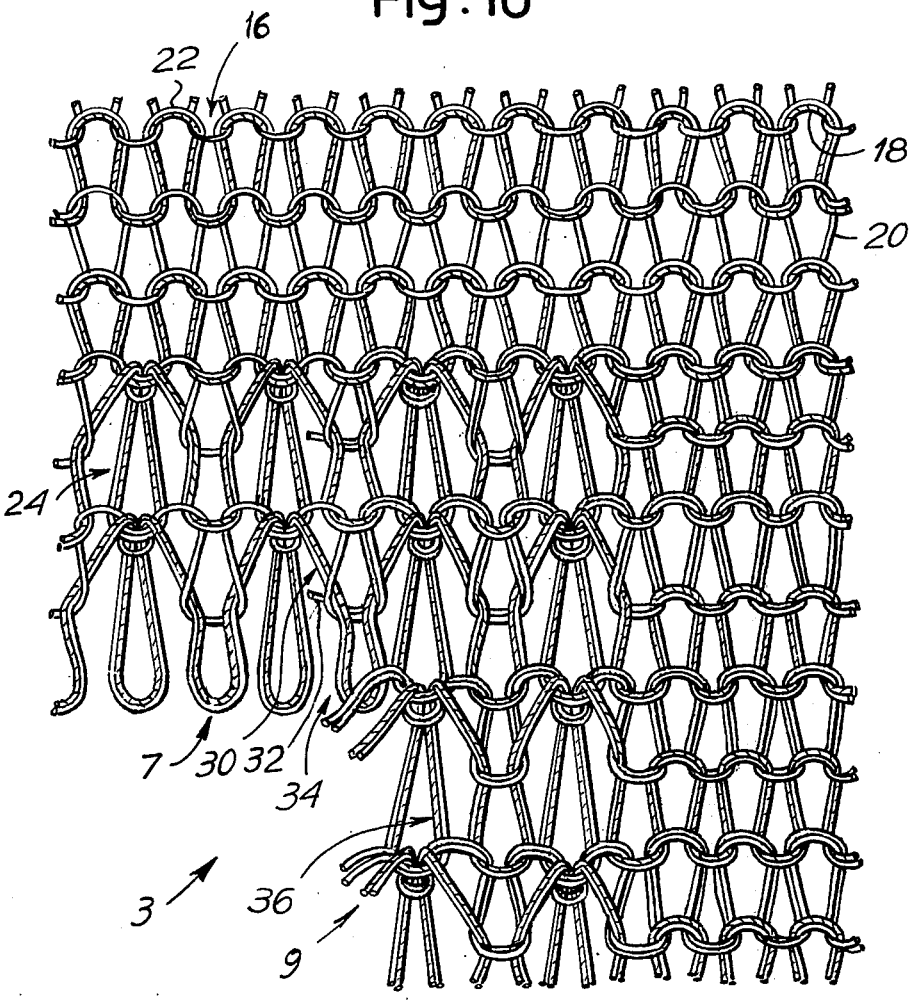
FIG. 10 is a pictorial stitch diagram illustrating a local enlarged portion of the typical zones surrounding the waist opening.

As the panty hose is formed in the direction of arrow $f_1$, a first outer edge zone 16 of fabric is formed as shown in FIGS. 3 and 10. An additional elastic yarn 18 is fed to alternating feeds in such a manner that the fabric in zone 16 includes a first course with the yarn 20 (feed A2 in FIG. 2) and a second course alternating therewith formed both by the yarn 22 and by an elastic yarn 18 (feed A1 in FIG. 2). The yarn 18 is seized by needles raised in a conventional manner up to needle path 19A. In the zones where the elastic yarn 18 is not to be seized, the needles are raised only to needle path 19B to pick up only yarn 22.

Figure 4:
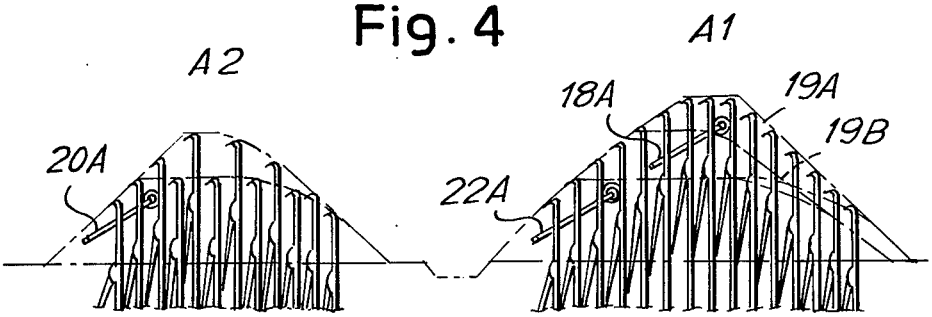
FIG. 4 is a schematic view illustrating the positioning of the incoming yarn and needle arrangement at two consecutive yarn feeds in an area adjacent the upper and lower lips of the waist opening of the panty hose.

After the forming of zone 16, a second edge zone 24 is formed immediately adjacent lip 7. The fabric in zone 24 is modified in the structure to be more elastic, with an increased tendency to roll up and with a tendency to resist raveling or breakdown of the stitches. Toward this end (See FIGS. 4, 5 and 10) in said portion 24, feed A1 directs the plain or non-elastic yarn 22A and the elastic yarn 18A in the same manner as illustrated in FIG. 2 with the path of the needles along the trajectory 19A. The exclusion of the elastic yarn 18A during knitting of the remainder of a cylinder rotation is accomplished by lifting the needles only to the lower trajectory or needle path 19B.

Figure 5:
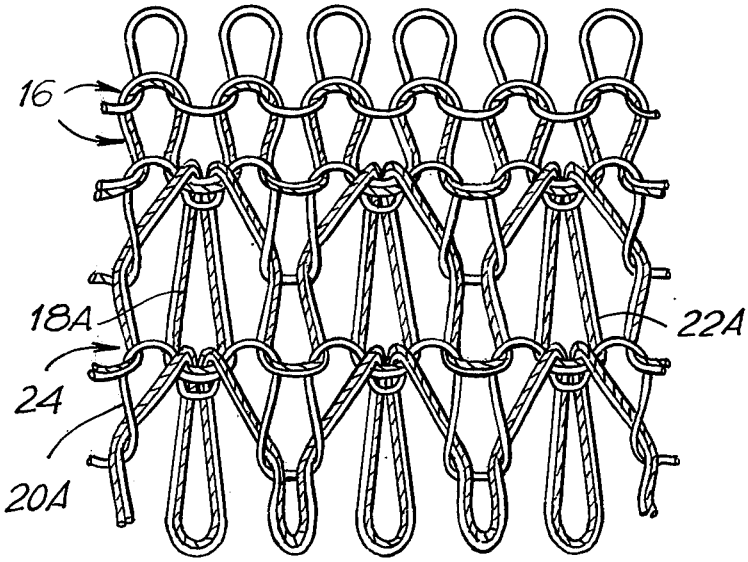
FIG. 5 is a pictorial stitch diagram illustrating the fabric formed in the zone of FIG. 4.
Figure 6:
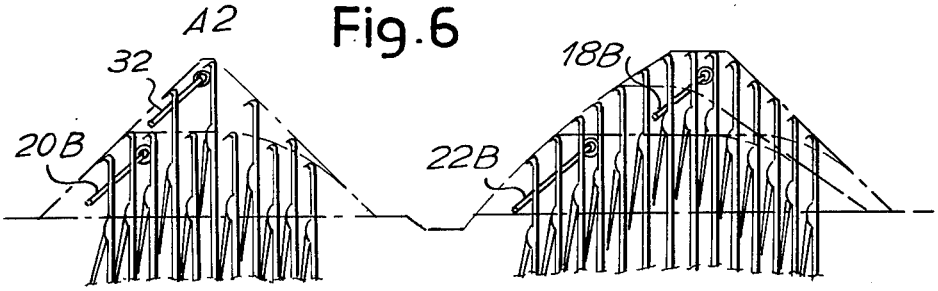
FIG. 6 is a schematic view illustrating the positioning of the incoming yarn and needle arrangement at two consecutive feeds for forming the fabric adjacent the side edges of the opening and the upper and lower edges of the opening near the end thereof.
Figure 7:
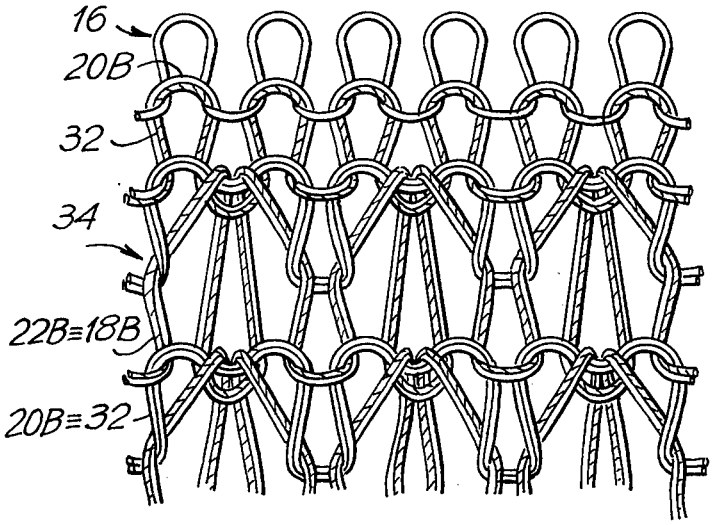
FIG. 7 is a pictorial stitch diagram illustrating the fabric formed from the set-up of FIG. 6.
Figure 8:
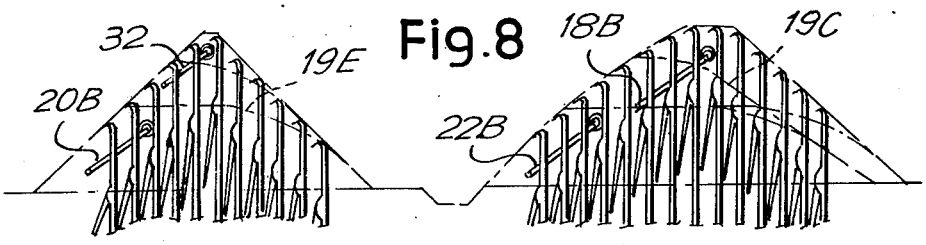
FIG. 8 is a schematic view illustrating the positioning of the incoming yarn and needle arrangement in the longitudinal edge zone adjacent the side edges of the waist opening.

The difference between zone 24 and zone 16 occurs at the second feed A2 (FIG. 4) wherein a non-elastic yarn 20A is introduced in the alternate course in alternating wales by means of a 1:1 needle selection in such a manner as to constitute the interlacing pattern shown in the lower portion of the fabric in FIGS. 5 and 10. This interlacing pattern is formed in a prescribed number of courses which is greater than that shown in FIG. 5, however for the purposes of drawing clarity, only two courses are shown and these are distorted to be representative of their resultant geometry from the contraction of an elastic yarn. FIGS. 5A and 10A show a geometrical representation of the stitches wherein K is the knit stitch (two yarns), k is the knit stitch (one yarn) and T is the tuck stitch. FIG. 7A is a similar geometric representation for the distorted showing of the loops in FIG. 7. The fabric structure thus formed in portion 24 provides increased elasticity of the fabric and a desired tendency to roll up along the edge or lip 7. The rolling tendency forms on one hand a finishing of said lip and on the other hand a protection against the raveling or break-down of the stitches cast off along the edge or lip 7.

The partial courses of fabric extending between edges 7 and 11 are formed as described hereinafter.

Once knitting is resumed after opening 3 is formed along edge 11, a zone 26 is formed similar to zone 24. Subsequently another outer edge zone 28 is formed similar to zone 16, whereupon the knitting of the fabric is continued to form the rest of the tubular leg 5.

Adjacent the end portions of edges 7 and 11 of the opening 3, a reinforced fabric is formed to better withstand the stresses which occur during use. In the portion between line 14 and the two marking lines 30 illustrated in FIGS. 1 and 10, a supplementary, preferably non-elastic yarn 32 is introduced (See FIGS. 6 through 9) at the same feed A2 where yarn 20B is introduced. Yarn 20B is the same as and corresponds with yarns 20, 20A in zones 16,24. Similarly, 18B corresponds with 18 and 18A and 22B corresponds with 22 and 22A. Feed A1 still introduces the non-elastic yarn 22B and the elastic yarn 18B as in zones 16,24. In the zones 34 of the reinforced fabric, which are developed along the end portions of edges 7 and 11, the reinforced fabric assumes the interlaced structure shown in FIG. 7, as the stitch as feed A2 is formed 1:1 and each stitch is constituted respectively with the two yarns 18B,22B in one course and yarns 20B,32 in the next course.

The longitudinal edge zone immediately adjacent edges 9 are formed with the same fabric structure as zone 34, with one course including one elastic and one non-elastic yarn and the subsequent course including two non-elastic yarns, and always with a 1:1 needle selection which provides the tendency to roll up and to resist raveling.

Figure 9:
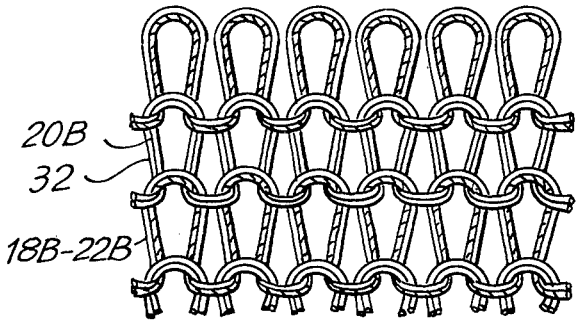
FIG. 9 is a pictorial stitch diagram of the fabric in the zone defined by FIG. 8.

In the longitudinal, outer edge zone 38 which lies between the line 14 and the zone 34,36, the fabric is formed with a plain stitch as illustrated in FIG. 9, with alternating courses wherein a first course includes the non-elastic yarns 32,20B and the other course includes an elastic yarn 18B and a non-elastic yarn 22B. The fabric in zones 34,36, and 38 thus formed is particularly strong to withstand stresses during the use. On the outside of lines 14, the fabric is formed only with yarns 20B and 22B, as the needles are always raised to follow a needle path which clears the stitches from the latches, said needle path being lower than that allowing the pickup of yarns 18B and 32, i.e. with lower yarn path trajectories as indicated by lines 19C and 19E in FIG. 8.

The article at the outer ends of portions 1 and 5 may be completed with a closure structure known as "closed toes."

It is apparent that the drawing and specification illustrate one embodiment which may be varied without departing from the scope of the invention which is to be determined by the following claims.

What is claimed is:

1. A knit construction for the waist portion of a one-piece panty hose comprising a tubular knit portion of body yarn having a generally rectangular waist opening including upper and lower transverse edges and a pair of longitudinal side edges therein, said body yarn being sheared longitudinally along said longitudinal side edges, said waist opening extending partially around the circumference of said tubular portion, an additional yarn comprising an elastic yarn knitted in selected courses in an outer transverse edge zone above and below each transverse edge of said opening, an inner transverse edge zone immediately adjacent each transverse edge of said opening having selected courses with stitches alternated with tuck stitches whereby the fabric along the edges of said opening offers a high degree of elasticity and a tendency to roll up, and longitudinal outer edge zones including courses having stitches with both elastic and non-elastic yarns alternated with courses having a first non-elastic yarn and a supplementary reinforcing yarn.

2. The construction according to claim 1 wherein said selected courses of the inner transverse edge zone comprise plain yarn stitches.

3. The construction according to claim 1 comprising inner longitudinal edge zones immediately adjacent each longitudinal edge of said opening including courses having stitches with elastic and non-elastic yarn, said courses along said inner longitudinal edge zones being developed along end portions of the transverse edges and including the stitches of said inner transverse edge zones.

4. The construction according to claim 3 wherein said inner longitudinal edge zones immediately adjacent each longitudinal edge zones immediately adjacent each longitudinal edge of said opening includes alternating first and second courses in which the first course includes one elastic and one non-elastic yarn and the second course includes two non-elastic yarns with a 1:1 needle selection.

5. The construction according to claim 1 wherein said transverse outer edge zone includes courses having stitches with both elastic and non-elastic yarns alternated with courses having only non-elastic yarns.

* * * * *